US010087836B2

(12) United States Patent
Rowe

(10) Patent No.: US 10,087,836 B2
(45) Date of Patent: Oct. 2, 2018

(54) FIRE PREVENTION SHIELD

(71) Applicant: Heath Rowe, Mungindi (AU)

(72) Inventor: Heath Rowe, Mungindi (AU)

( * ) Notice: Subject to any disclaimer, the term of this patent is extended or adjusted under 35 U.S.C. 154(b) by 0 days.

(21) Appl. No.: 15/106,585

(22) PCT Filed: Dec. 19, 2014

(86) PCT No.: PCT/AU2014/050438
§ 371 (c)(1),
(2) Date: Jun. 20, 2016

(87) PCT Pub. No.: WO2015/089589
PCT Pub. Date: Jun. 25, 2015

(65) Prior Publication Data

US 2017/0030263 A1 Feb. 2, 2017

(30) Foreign Application Priority Data

Dec. 19, 2013 (AU) ..... 2013904960

(51) Int. Cl.

| | |
|---|---|
| ***F02B 77/08*** | (2006.01) |
| ***F02B 77/11*** | (2006.01) |
| ***F01P 1/06*** | (2006.01) |
| ***F01N 13/08*** | (2010.01) |
| ***F01N 13/18*** | (2010.01) |
| *F01P 1/00* | (2006.01) |

(52) U.S. Cl.
CPC ..... *F02B 77/11* (2013.01); *F01N 13/082* (2013.01); *F01N 13/1822* (2013.01); *F01P 1/06* (2013.01); *F01N 2260/022* (2013.01); *F01N 2260/20* (2013.01); *F01N 2590/08* (2013.01); *F01P 2001/005* (2013.01)

(58) Field of Classification Search
CPC .... F02B 77/11; F01N 13/082; F01N 13/1822; F01N 2260/022; F01N 2260/20; F01N 2590/08; F01P 1/06; F01P 2001/005
USPC ..... 123/198 D
See application file for complete search history.

(56) References Cited

U.S. PATENT DOCUMENTS 1,794,276 A * 2/1931 Bowes ..... F01N 3/05 181/262
2,396,952 A * 3/1946 Huber ..... F01N 1/083 165/123
3,237,716 A * 3/1966 Parsons ..... F01N 13/14 138/178
4,265,332 A * 5/1981 Presnall ..... F01N 3/05 165/52

(Continued)

OTHER PUBLICATIONS

International Application No. PCT/AU2014/050438 Written Opinion dated Apr. 17, 2015 (5 pages).

*Primary Examiner* — Hung Q Nguyen
*Assistant Examiner* — Anthony Taylor, Jr.
(74) *Attorney, Agent, or Firm* — Keller Jolley Preece

(57) ABSTRACT

The present application provides a fire prevention shield for an internal combustion engine. The shield includes a shield baffle plate and a mounting means adapted to mount the shield baffle plate at a predetermined position with respect to a muffler of the engine, such that an air passage is located between the muffler and the shield baffle plate, the air passage having an air inlet opening located adjacent to the engine, wherein a cross-sectional area of the air passage is greatest at or near the air inlet opening.

9 Claims, 13 Drawing Sheets

(56) References Cited

U.S. PATENT DOCUMENTS

| | | | | | |
|---|---|---|---|---|---|
| 4,612,767 | A * | 9/1986 | Engquist | F01N 13/14 | 60/321 |
| 4,741,411 | A * | 5/1988 | Stricker | F01N 3/05 | 181/240 |
| 5,174,406 | A | 12/1992 | Lee | | |
| 5,347,810 | A * | 9/1994 | Moore, III | F01N 13/102 | 181/240 |
| 5,464,952 | A * | 11/1995 | Shah | B29C 70/088 | 180/89.2 |
| 5,496,069 | A * | 3/1996 | Milligan | B60K 15/03 | 252/62 |
| 5,844,177 | A * | 12/1998 | Pirchl | B60R 13/08 | 180/89.2 |
| 7,263,827 | B2 * | 9/2007 | Oshima | F01N 13/08 | 248/62 |
| 8,439,141 | B2 * | 5/2013 | Bessho | B60K 5/04 | 180/339 |
| 2004/0216453 | A1 | 11/2004 | Oshima et al. | | |

* cited by examiner

FIRE PREVENTION SHIELD

RELATED APPLICATION

This application is a national phase entry under 35 U.S.C. § 371 of International Application No. PCT/AU2014/050438, filed Dec. 19, 2014, which claims the benefit of Australian Application No. 2013904960, filed Dec. 19, 2013. The entire contents of each of the foregoing patent applications are hereby incorporated by reference.

TECHNICAL FIELD

This invention relates to a fire prevention shield and, in particular, to a fire prevention shield for use with agricultural machinery. However, it will be appreciated by those skilled in the art that the fire prevention shield can be used with other machinery and in other applications.

BACKGROUND

Agricultural machinery such as (but not limited to) harvesters, tractors, mowers, shakers, balers, threshers, and mulchers typically operate in environments where they are exposed to combustible vegetation material. The combustible vegetation material, such as dry grass, hay and wheat stems, can smoulder and eventually ignite if it comes into contact with various external portions of an internal combustion engine. This is a result of the high internal operating temperatures present within the engine, and the presence of heated exhaust gasses.

Silencers or mufflers are connected to the exhaust system of most internal combustion engines. A muffler is intended to reduce the sound pressure of the exhaust gasses, and hence reduce the noise output by the engine. There are numerous types of mufflers which are commercially used. However, one factor common to all mufflers is the generation of a significant amount of heat.

It is known for combustible vegetation material to foul or build up on those parts of an internal combustion engine which become heated, such as the muffler. In particular, combustible material is known to accumulate on or around the silencer or muffler of internal combustion engines used to power agricultural equipment.

Agricultural equipment, such as harvesters and the like, have sometimes been destroyed by fire caused by a build-up of debris on or close to hot engine components of internal combustion engines used to power such equipment. As a result, not only is there a risk of the agricultural equipment being destroyed or badly damaged, but such fires can conflagrate to larger fires, which can destroy large areas of bush and/or crops, building assets, and other equipment.

It is sometimes necessary for a user to access the engine compartment of agricultural equipment, for maintenance, repair and operational purposes, and accidental contact with hot parts of the engine has been known to cause serious personal injury. In a typical arrangement, an item of agricultural equipment has an internal combustion engine fitted with a cooling fan arranged to direct air past the engine and having an exhaust with a silencer mounted substantially parallel to a hood or bonnet and transverse to the flow of air directed by the cooling fan. Hereinafter, this arrangement will be referred to as an internal combustion engine of the type described, unless the context indicates otherwise.

Agricultural machinery such as harvesters pose a significant risk of burn injuries in respect of the muffler, as the engine is typically compact, and hence the muffler is located relatively close to the engine. The reduced exhaust manifold distance between the engine and the muffler results in high temperatures occurring on the surface of the muffler, which after prolonged periods of engine use may result in very high muffler temperatures.

Another known problem with some agricultural machinery is the issue of engine noise. The high levels of power required for some agricultural products, and the proximity of the driver/operator to the engine, dictate that noise levels are often significantly greater than would be acceptable in the design of comparable consumer use vehicles.

OBJECT OF THE INVENTION

It is an object of the present invention to substantially overcome or at least ameliorate one or more of the above disadvantages, or to provide a useful alternative.

SUMMARY

In a first aspect, the present disclosure provides a fire prevention shield for an internal combustion engine, including:

a shield baffle plate; and a mounting means adapted to mount the shield baffle plate at a predetermined position with respect to a muffler of the engine, such that an air passage is located between the muffler and the shield baffle plate, the air passage having an air inlet opening located adjacent to the engine, wherein a cross-sectional area of the air passage is greatest at or near the air inlet opening;

wherein a longitudinal axis of the shield baffle plate extends generally perpendicular to a longitudinal axis of the internal combustion engine, such that the air inlet opening is oriented to receive airflow generated by a cooling fan of the internal combustion engine.

In a second aspect, the present disclosure provides a fire prevention shield for an internal combustion engine including:

a shield baffle plate; and a mounting means adapted to mount the shield baffle plate at a predetermined position with respect to a muffler of the engine, such that an air passage is located between the muffler and the shield baffle plate, the air passage having an air inlet opening located adjacent to the engine, wherein a cross-sectional area of the air passage is greatest at or near the air inlet opening;

the shield baffle plate includes at least one mounting bracket, the mounting bracket having:

a body portion secured to the shield baffle plate, a generally arcuate cut-out being defined in the body portion; and an arcuate plate secured to the arcuate cutout to define an arcuate step;

wherein the mounting means includes a generally circular clamp adapted to circumferentially surround the muffler, and the arcuate step is adapted to be secured between the circular clamp and the muffler.

BRIEF DESCRIPTION OF THE DRAWINGS

One or more embodiments of the invention will now be described by way of specific example with reference to the accompanying drawings, in which.

DETAILED DESCRIPTION

Figure 1A:
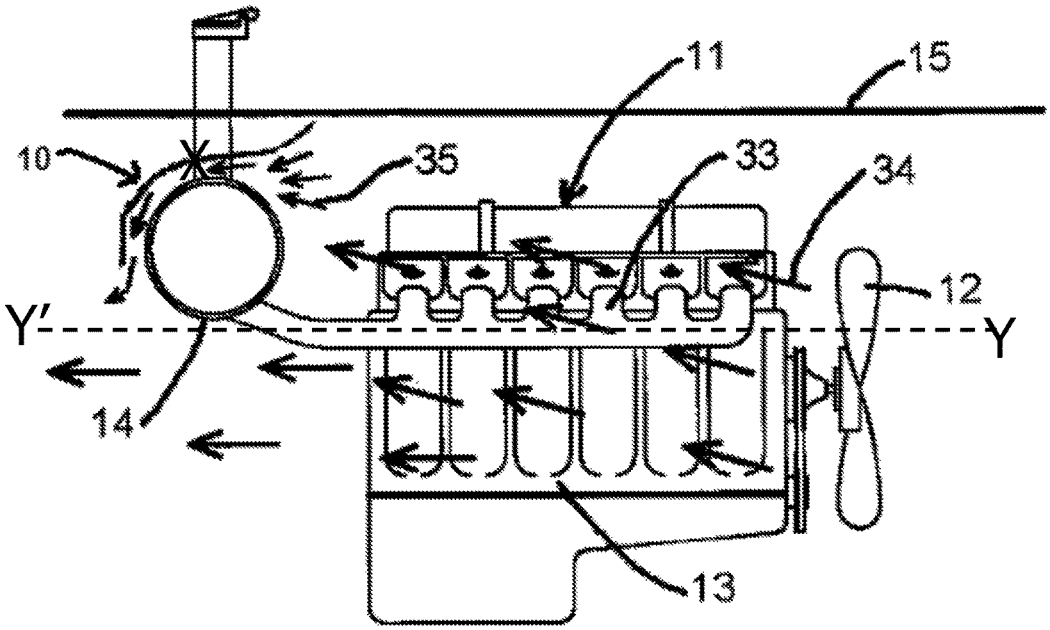
FIGS. 1*a* and 1*b* are diagrammatic side views of a fire prevention shield according to the invention mounted to an internal combustion engine of the type described.

Method steps or features in the accompanying drawings that have the same reference numerals are to be considered to have the same function(s) or operation(s), unless the contrary intention is expressed or implied.

Overview

A first aspect of the present disclosure resides broadly in a fire prevention shield for an internal combustion engine of the type described including a shield baffle and mounting means for mounting the shield baffle at a predetermined position with respect to a silencer of the internal combustion engine, the shield baffle having:

a leading portion extending rearward and downwardly from a leading edge, the leading edge being in close proximity to the underside of the hood and windward of the silencer with respect to the flow of air;

a deflection portion extending rearward and downwardly from the leading portion, the deflection portion being in spaced disposition with respect to the silencer and shaped to extend at a substantially constant distance from an external face of the silencer; and a trailing portion extending downwardly from the deflection portion and to a trailing edge.

Preferably, the deflection portion extends around an upper and rearward quarter of the circumference of the silencer. Accordingly, the deflection portion has a curvature commensurate with the spaced disposition from the silencer, the curvature being substantially coaxial with the curvature of the outside face of the silencer. It is preferred that the extent of the curvature of the deflection portion is from 45° to 90° degrees of arc.

Preferably, the leading portion is substantially planar and extends rearward and downwardly from the leading edge. In such form, the leading portion has a transition edge disposed rearward of the leading edge, the transition edge comprising a fold at an obtuse angle, the deflection portion extending from the fold.

Alternatively, the leading portion is curved to an opposite curvature to that of the deflection portion. In such form, a transition portion is interposed between the leading portion and the deflection portion. The transition portion is preferably substantially planar and diverges away from the hood in the rearward direction.

In a further alternative form, the leading portion is planar as hereinbefore described and a transition portion as hereinbefore described is interposed between the leading portion and the deflection portion. It is also preferred that the shield baffle be formed of a material which includes at least some silicone which has a high temperature stability.

DESCRIPTION OF EMBODIMENTS

Harvesters and other pieces of agricultural equipment have been destroyed or at least damaged by fires caused by debris build-up close to hot engine components, and in particular the muffler. These incidents have not only destroyed an expensive piece of machinery, but have been known to destroy large areas of crops and cause serious personal injury. The present disclosure provides a fire prevention shield, or heat shield 5, to assist in the prevention (or at least reduce the risk) of fires associated with agricultural machinery, particularly grain harvesters, and is described herein with reference to such application.

The fire prevention shield 5 is fabricated from aluminium or another suitable material which has favourable heat dissipation properties and is rust resistant. The fire prevention shield 5 may be fabricated by way of a folding process from a single sheet of aluminium.

Figure 1B:
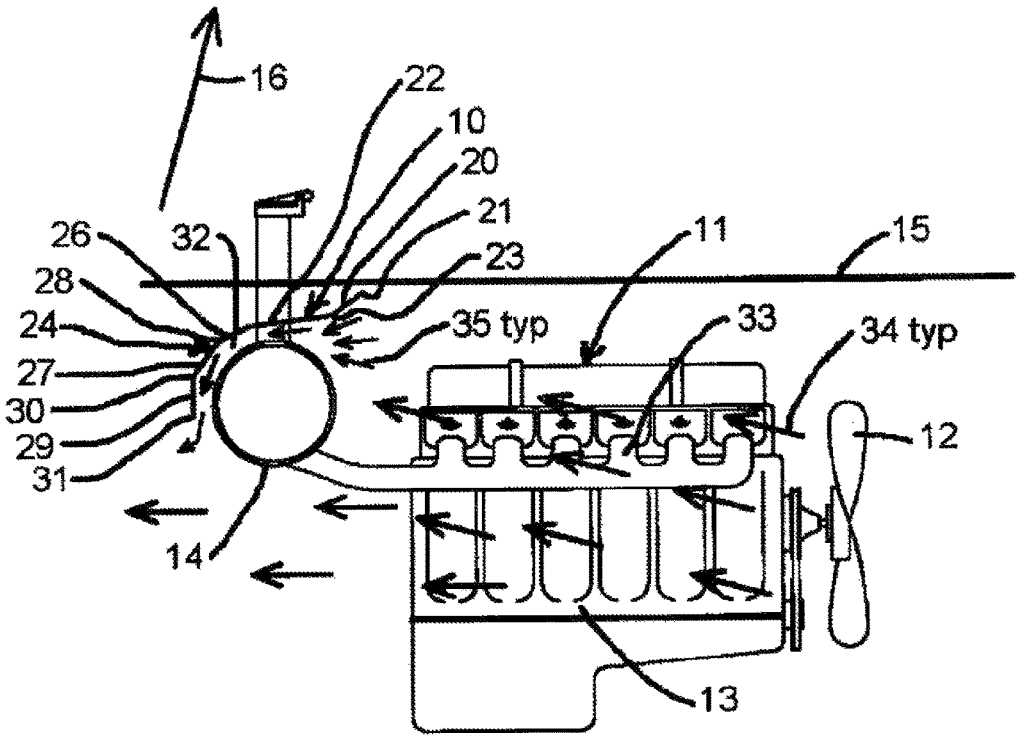
Figure 2:
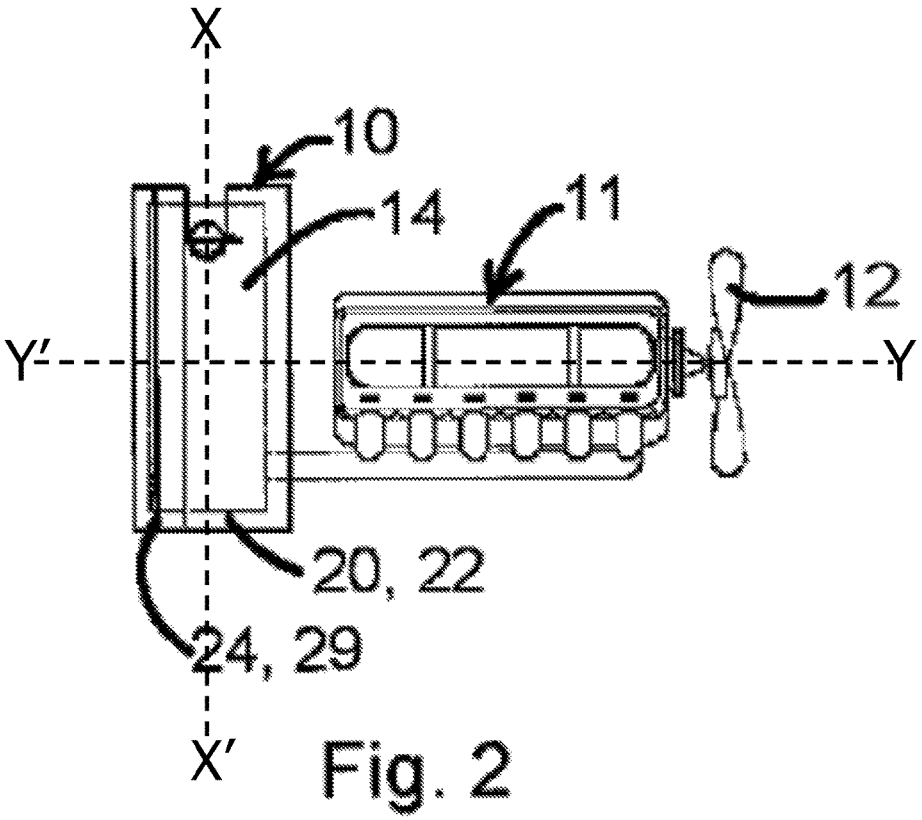
FIG. 2 is a diagrammatic plan view from the top of the fire prevention shield and engine of FIGS. 1*a* and 1*b;*

The fire prevention shield 5 includes a shield baffle plate 10 illustrated in FIGS. 1*a*, 1*b*, and 2 and is mounted by mounting means (not shown in FIGS. 1*a*, 1*b*, and 2) to an engine 11 of the type described having a cooling fan 12, an engine block 13 behind the cooling fan and a silencer or muffler 14 located behind and above the engine block 13. The engine 11 and shield baffle plate 10 are covered by a hood 15 which is typically pivotable about a hinge generally forward of the engine 11 from a closed position as shown to an open position in the direction of arrow 16. However, it will be appreciated that other hinge configurations and rotation directions of the hood 15 are possible.

The shield baffle plate 10 includes a leading portion 20 (located closest to the engine block 13) having a leading edge 21 in close proximity to the hood 15. The leading edge 21 is spaced beneath the underside of the hood 15 a distance sufficient that there is no contact with the hood 15 caused by vibration of the engine 11. An intermediate portion 22 extends rearward and downwardly from the leading portion 20 and is contiguous therewith, joining to the leading portion 20 by an intermediate bend 23. The leading portion 20 extends rearward and downwardly from the leading edge 21 and is at a shallower angle than that of the intermediate portion 22, both portions 20, 22 being substantially planar.

Figure 11:
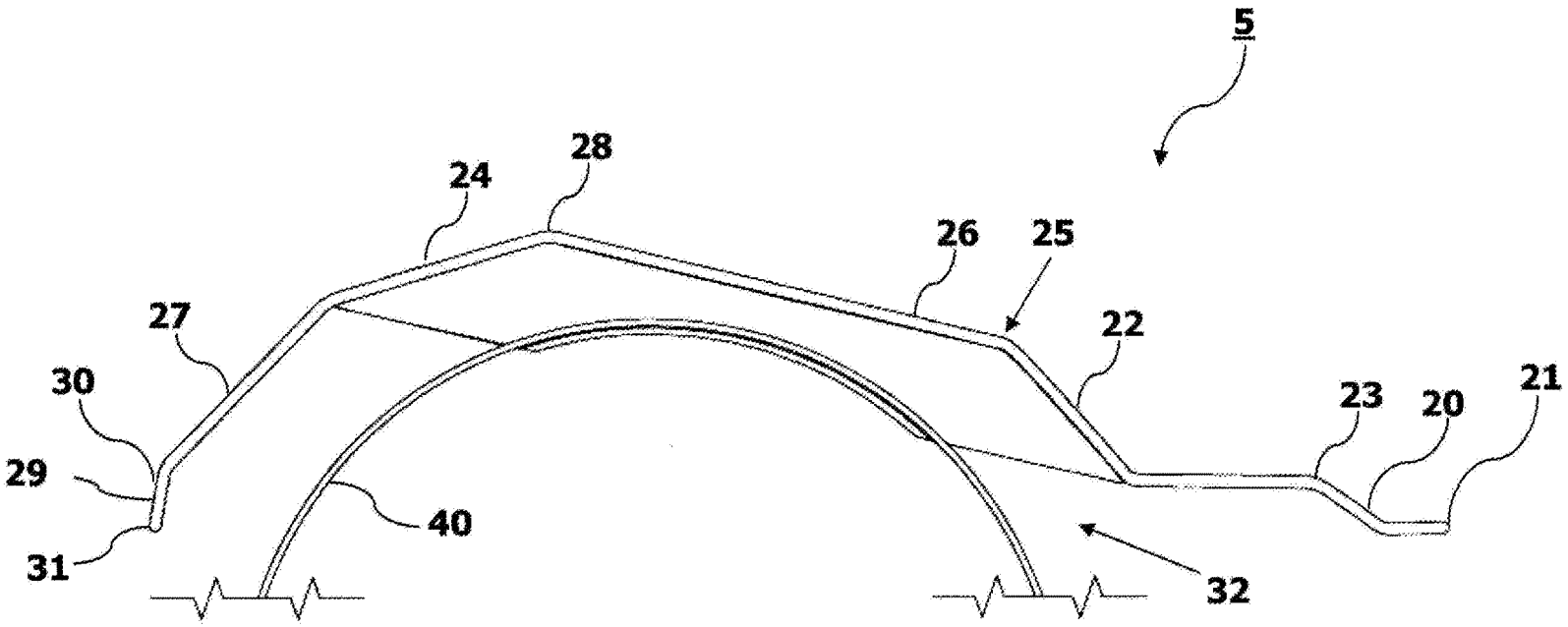
FIG. 11 is an enlarged side detail of the fire prevention shield of FIG. 7.

As depicted in FIG. 11 for example, the deflection portion 24 extends rearward and downwardly from a rearward edge 25 of the intermediate portion 22 and has forward panel 26 and a rearward panel 27 extending therefrom. The forward and rearward panels 26, 27 are at an obtuse angle to one another along a middle bend 28. The angles of the forward and rearward panels 26, 27 are selected to provide an approximate curvature around the muffler 14. A trailing portion 29 extends downward from a trailing end 30 of the deflection portion 24, the angle being substantially vertical as shown in FIGS. 1*a* and 1*b*. The trailing portion 29 terminates in a trailing edge 31 (located furthest from the engine block 13).

The fire prevention shield includes mounting means 40 for mounting at the position described to provide an air passage 32 between the muffler 14 and the shield 5. Airflow generated by the cooling fan 12 passes the engine block 13 and exhaust manifold 33 in the direction of the larger arrows indicated typically at 34, into the air inlet opening 35. Some of the air is directed into the air passage 32 to pass at relatively higher speed by virtue of the leading portion 20 being spaced further from the muffler 14 than the intermediate portion 22, and together the leading and intermediate portions 20, 22 providing the air passage with a contracting cross-sectional area. As such, the opening of the air passage 32 is relatively large in cross-sectional area, providing a funneling effect to channel more air into the air passage 32.

Air therefore flows past the muffler 14 in the direction of the smaller arrows indicated typically at 35 to join the remainder of the air flowing to the rear of the engine 11. The narrowing cross-sectional area in the air passage 32 results in a venturi effect, whereby the air pressure decreases, as the air passes through a constriction.

In use, the fire prevention shield according to the invention, when mounted to an engine of the type described, causes an accelerated flow of air past the muffler 14. For example, in one form, it has been found that air passing across the engine at idle speed is 25 km/hr and at operational speed is 75 km/hr. However, with the shield baffle according to the invention being installed, it has been found that the air passing through the flow passage is at about 65 km/hr at idle speed and at operational speed is from 95 to 104 km/hr. Moreover, the temperature of the silencer at both idle speed and operational speed was found not to exceed 65° C. and there was substantially no build-up of combustible material about the silencer.

The primary function of the fire prevention shield 5 is to capture and direct the air current from the cooling fan 12 between the muffler 14 and the fire prevention shield 5 into the air passage 32. This is also assisted by the hood 15 or engine access cover which works as an extension of the fire prevention shield 5. A high pressure system is created which increases air velocity past the muffler 14. This assists in the removal of debris circulating around the engine bay.

The fire prevention shield 5 also assists in preventing debris from falling onto the hot muffler 14 when the engine access cover is opened and helps protect against personal injury by acting as a physical guard, which is insulated by the air space defined by the air passage 32.

Research has shown that muffler 14 temperatures under normal working conditions start from approximately 280° C. and can easily rise to temperatures which can cause ignition of harvest trash when choked with debris.

A preferred material for the construction for the shield baffle includes aluminium for the main body, because the leading edge is constantly further from the hot silencer than the rest of the shield baffle. This edge also receives directed air currents from the cooling fan. It is suggested that the high thermal conductivity rate of aluminium would be advantageous in keeping the shield baffle at acceptable temperatures. However, it will be appreciated that it would be possible to manufacture this product out of many different materials. It has also been found that an aluminium shield baffle is very effective if it is coated with a high-temperature ceramic, such as a silicone paint having high temperature stability. In such form, it has been found that the shield baffle did not rise to a high enough temperature to cause burn injury when touched.

Figure 3:
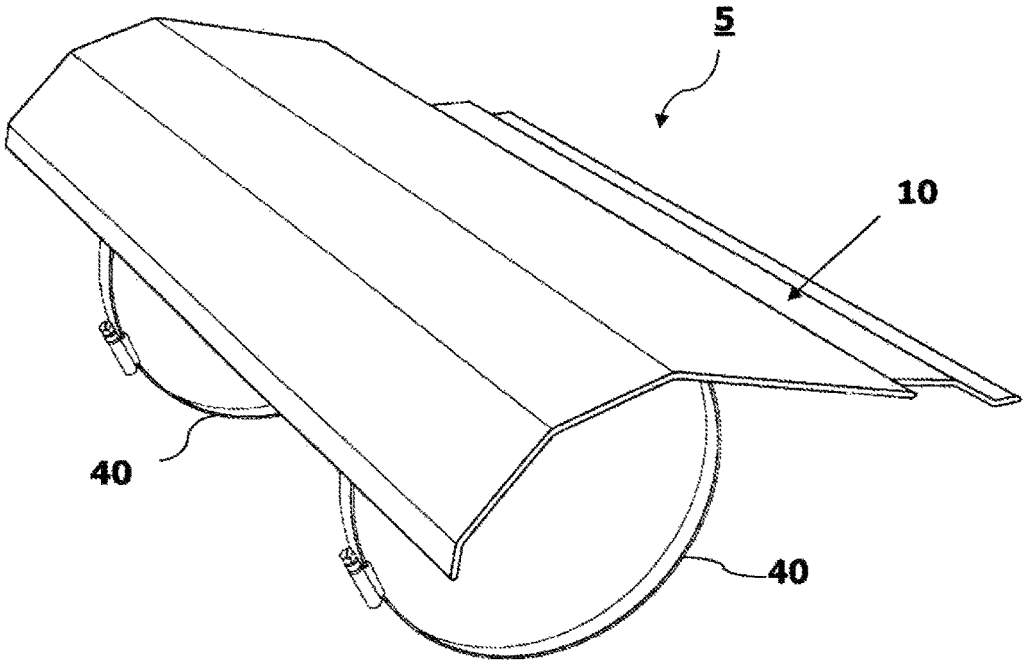
FIG. 3 is a rear perspective top view of a fire prevention shield.
Figure 4:
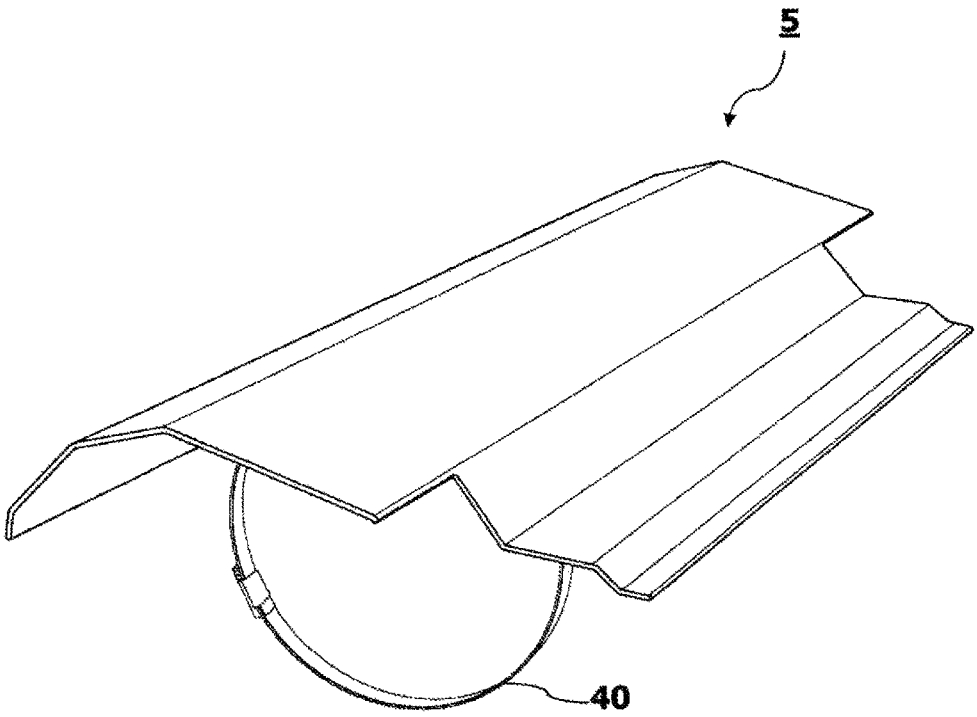
FIG. 4 is a front perspective top view of a fire prevention shield.

FIG. 3 is a rear perspective top view of a fire prevention shield 5 having mounting means in the form of a pair of worm drive clamps 40. Each worm drive clamp 40 (or other suitable clamp) is of a size suitable for coupling to a muffler 14 of an engine. FIG. 4 is a front perspective top view of the fire prevention shield 5 of FIG. 3.

Figure 5:
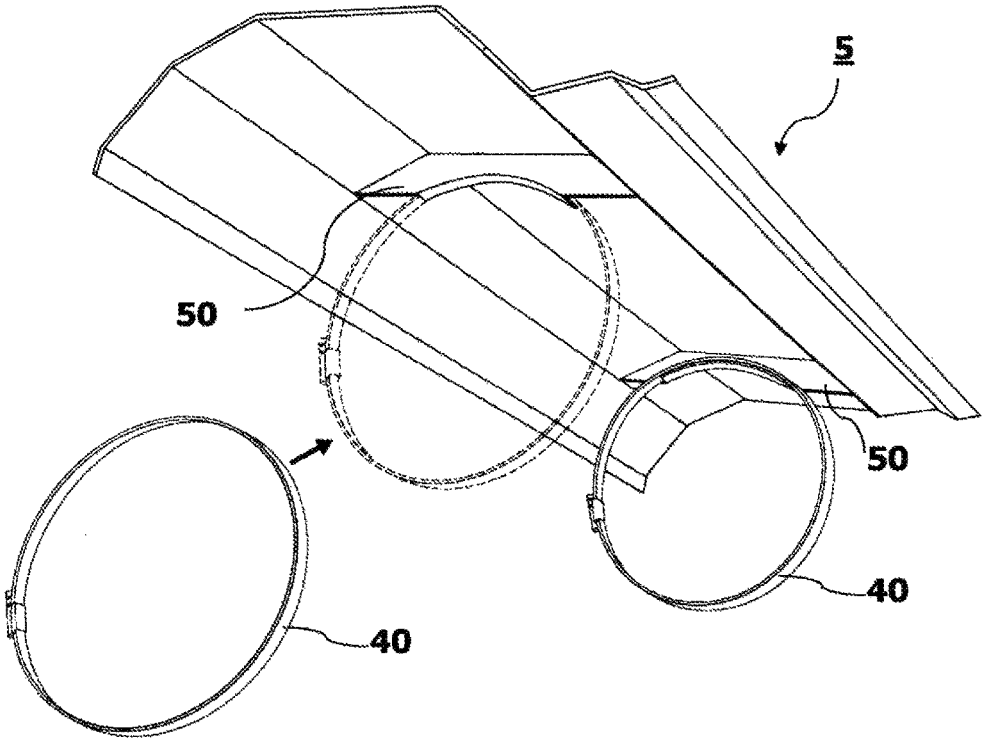
FIG. 5 is a front perspective bottom view of a fire prevention shield, showing mounting brackets and fastening straps.

FIG. 5 is a front perspective bottom view of the fire prevention shield 5 of FIG. 3, showing mounting brackets 50 and the pair of worm drive clamps 40. Each of the mounting brackets 50 has a concave portion adapted to abut against a generally cylindrical portion of the muffler 14. Each worm drive clamp 40 is coupled to a bracket 50.

In particular, each mounting bracket 50 has a body portion 52 which is welded or otherwise secured to the shield baffle plate 10. The body portion 52 has a generally arcuate cut-out and an arcuate plate 54 is secured to the arcuate cutout. As such, the arcuate plate 54 is designed to abut against the muffler 14, and provides a step which acts as a support surface for the worm drive clamps 40 to sit on. Accordingly, in use, when the worm drive clamp 40 is tightened, the arcuate plate 54 is clamped between the muffler 14 and the worm drive clamp 40. This arrangement is best shown in FIGS. 6 and 7, and the detail of FIG. 10.

Advantageously, the mounting bracket 50 enables the shield baffle plate 10 to be readily adjusted. This means that a user can adjust the position and size of the air input opening 35 of the air passage 32.

Figure 6:
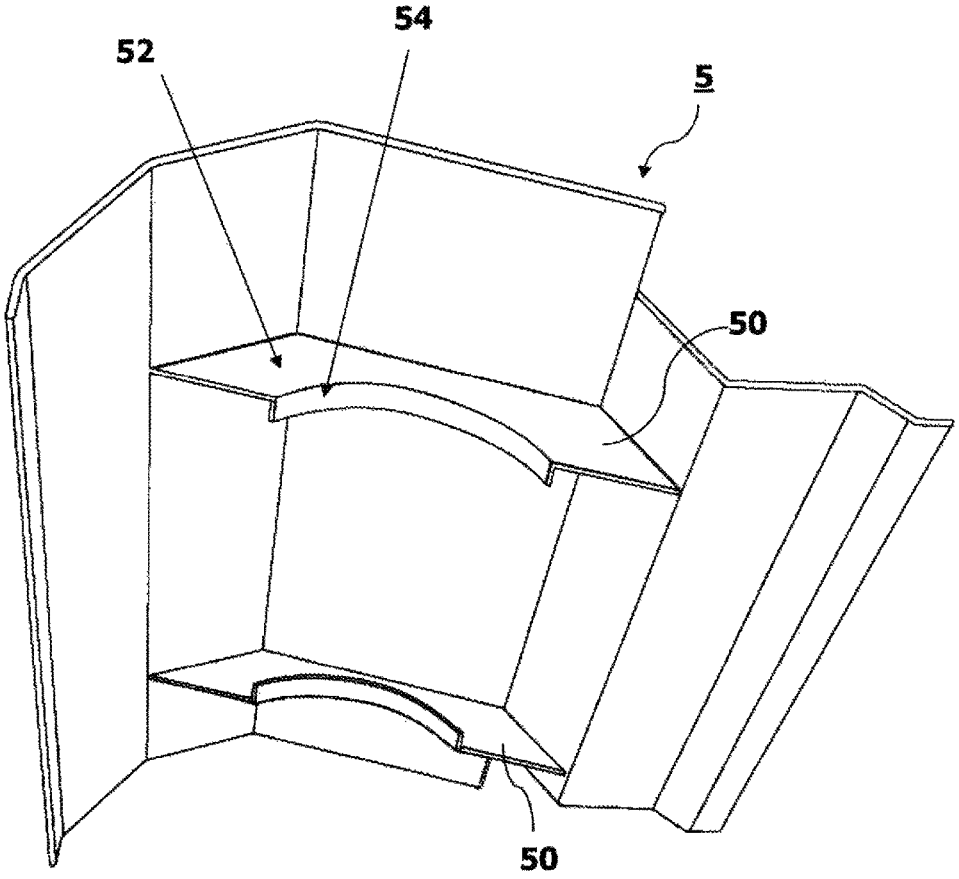
FIG. 6 is a perspective bottom view of a fire prevention shield, showing mounting brackets.

FIG. 6 is a perspective bottom view of the fire prevention shield 10, showing the mounting brackets 50 without the worm drive clamps 40 affixed.

Figure 7:
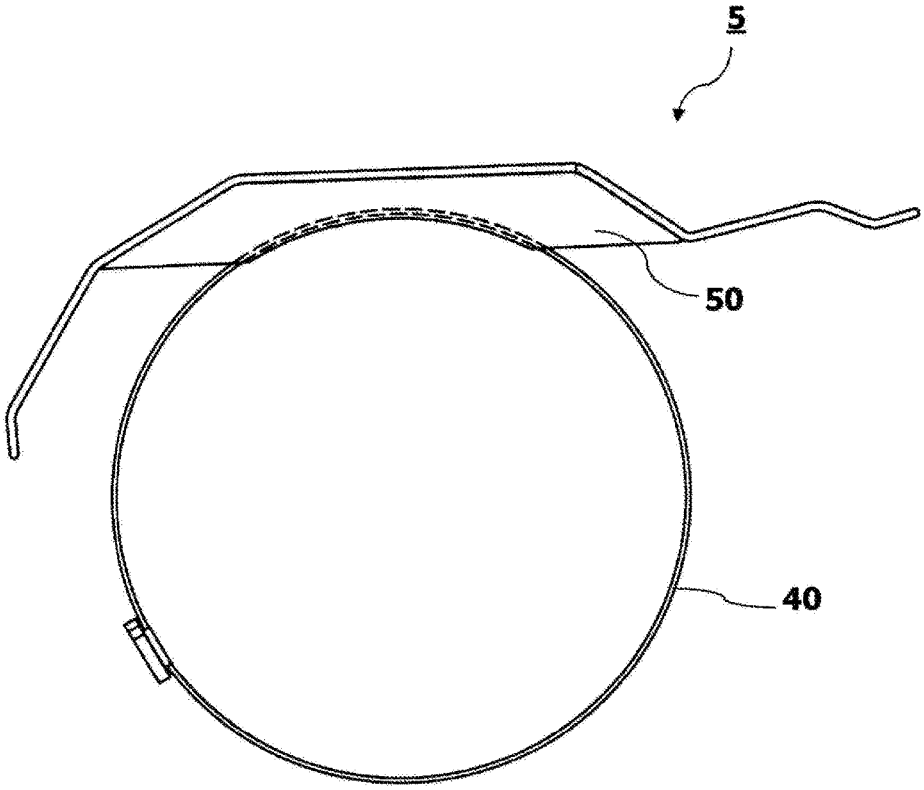
FIG. 7 is a side view of a fire prevention shield.
Figure 8:
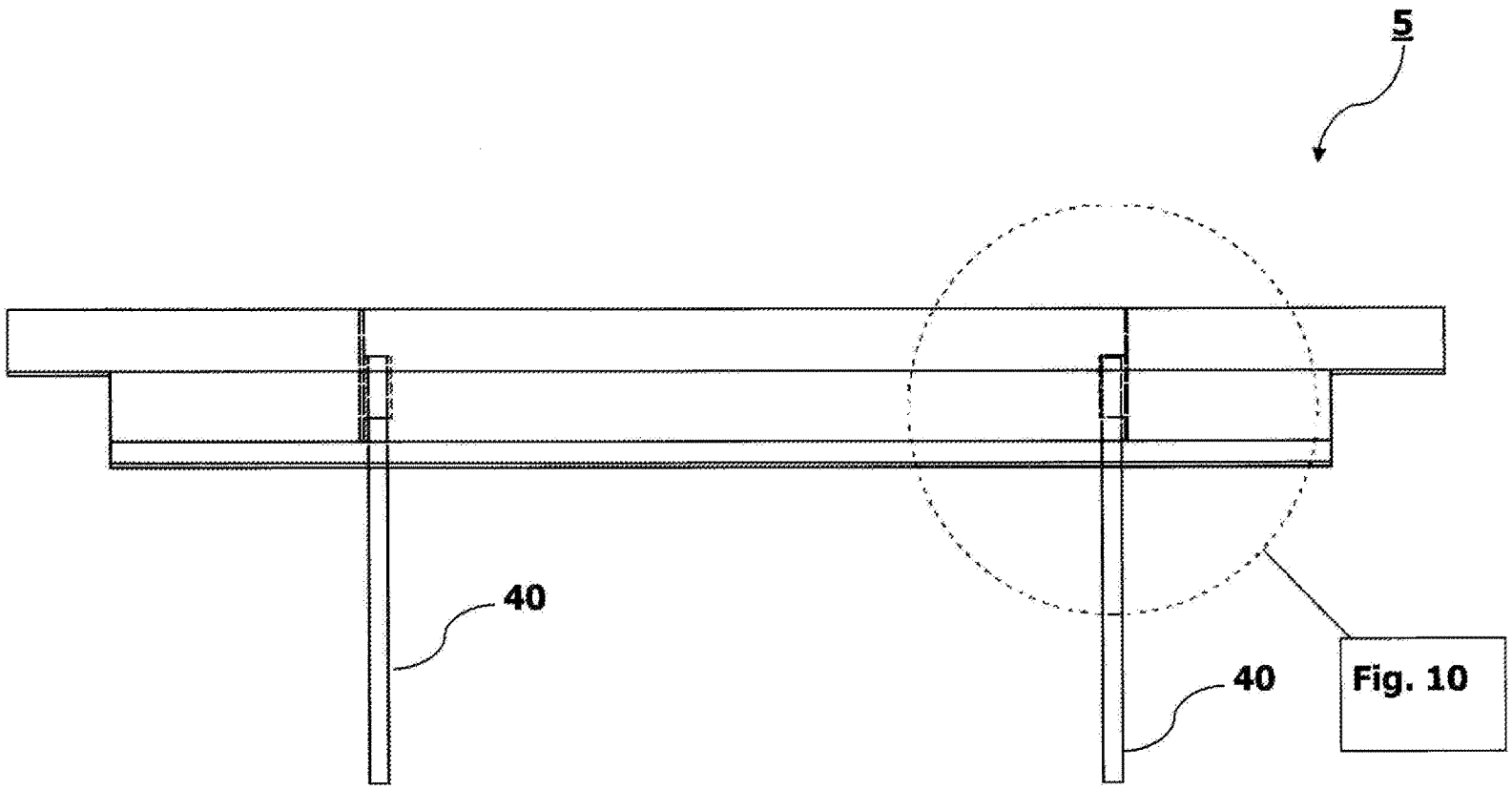
FIG. 8 is a front view of a fire prevention shield.

FIG. 7 is a side view of the fire prevention shield 10, showing the mounting bracket 50 and worm drive clamp 40. FIG. 8 is a front view of the fire prevention shield 10, showing the worm drive clamps 40.

Figure 9:
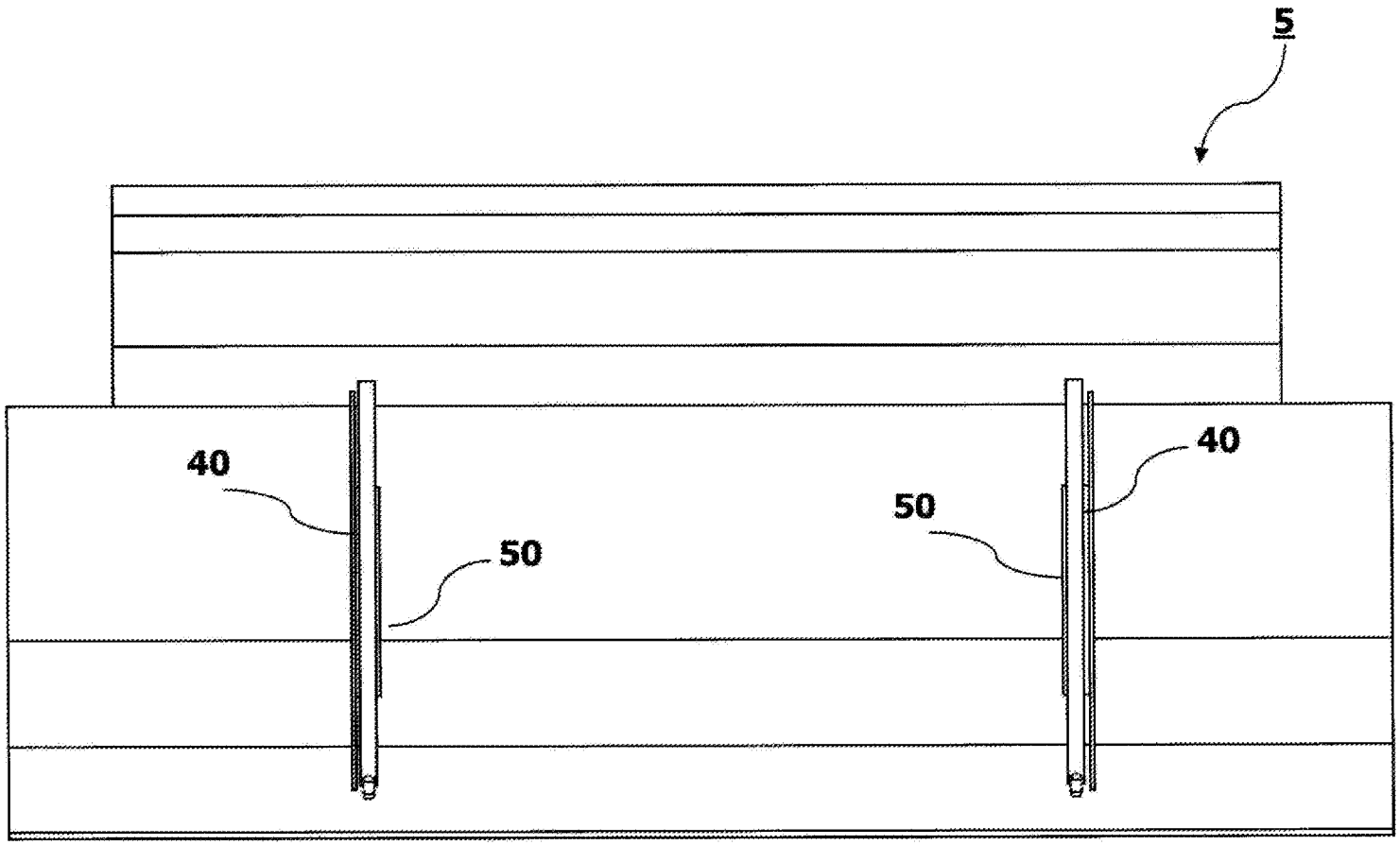
FIG. 9 is a bottom view of a fire prevention shield.

FIG. 9 is a bottom view of the fire prevention shield 10, showing the mounting brackets 50 and the worm drive clamps 40.

Figure 10:
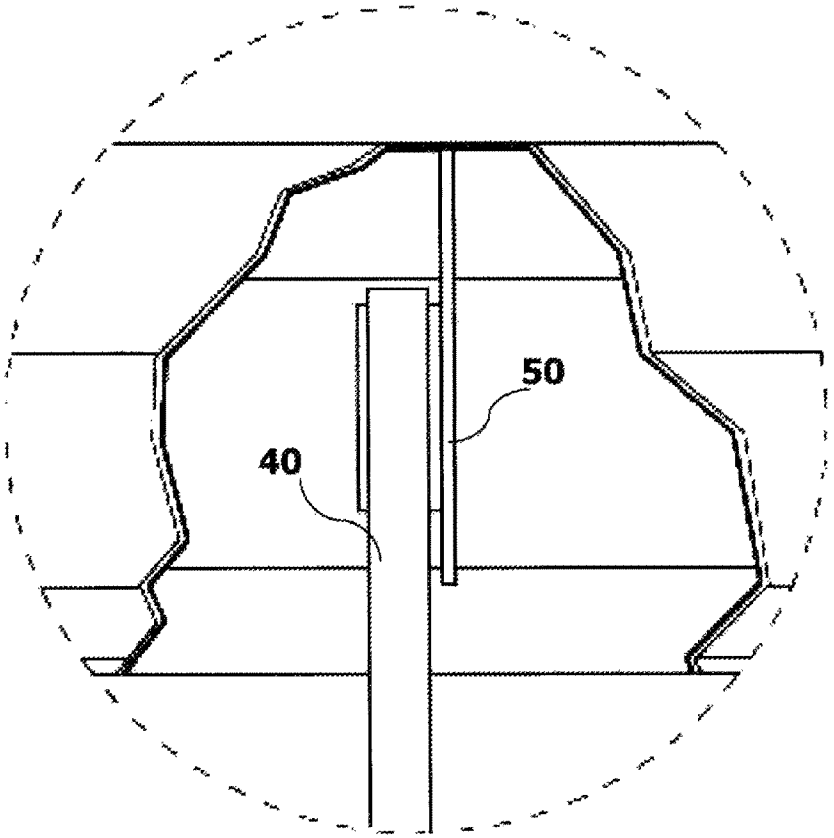
FIG. 10 is a cut away detail of FIG. 8, showing a fastening strap and mounting bracket.

FIG. 10 is a cut away detail of FIG. 8, showing a mounting bracket 50 and worm drive clamp 40.

FIG. 11 is an enlarged side detail of the fire prevention shield 10 of FIG. 7.

Figure 12:
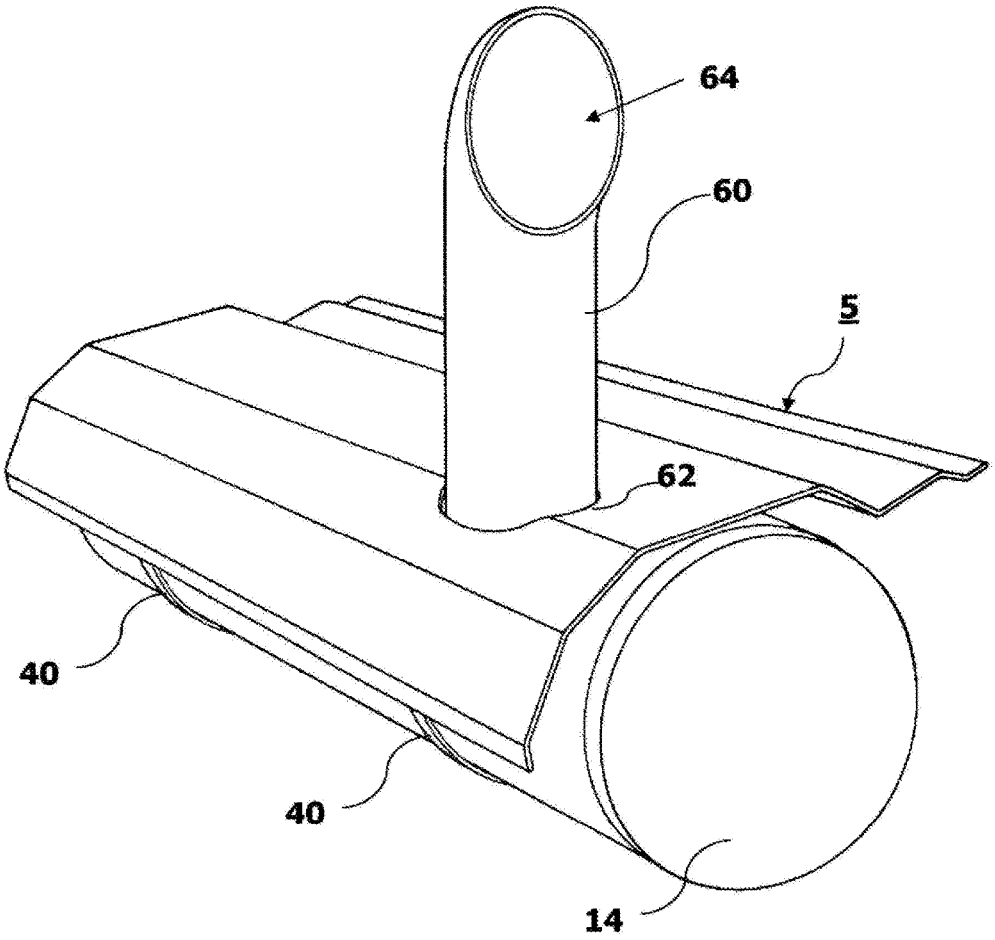
FIG. 12 is a perspective view of a fire prevention shield and exhaust extension in use, secured to a silencer.

FIG. 12 is a perspective view of a fire prevention shield 5 and exhaust extension 60 in use, secured to a silencer 14. In this example, the fire prevention shield 10 has an aperture 62 through which the exhaust extension 60 is fitted. The exhaust extension 60 is coupled to an exhaust outlet 64 of the silencer 14 and directs exhaust gases from the muffler 14 away from an operating cabin of the equipment to which the silencer 14 is attached. The exhaust extension 62 is of sufficient length to direct hot exhaust gases away from the muffler 14 and other engine parts. Further, the exhaust extension 60 optionally has an aperture that can be positioned to direct exhaust noise and gases away from an operator of the equipment.

The exhaust extension 60 may be fitted to the muffler 14 individually or in combination with the fire prevention shield 10.

The fire prevention shield according to the invention may be provided on new harvesting equipment or made up as a kit for installation on existing harvesters as a retro-fit. Similarly, the exhaust extension 60 may be provided on new equipment or presented as a separate component suitable for retro-fitting to existing equipment.

The shield baffle plate 10 may be perforated, providing apertures for improved heat dissipation and/or air flow.

Whilst the shield baffle plate 10 has been described with several planar surface intersecting at fold/bend seams, it will be appreciated that the shield baffle plate 10 may be formed as a curved plate, generally complimenting the curvature of the muffler 14, but still providing an increased cross-sectional area at the opening of the air passage 32, to direct the air current from the cooling fan 12 between the muffler 14 and the fire prevention shield 5 into the air passage 32.

Although the invention has been described with reference to specific examples, it will be appreciated by persons skilled in the art that the invention may be embodied in other forms within the broad scope and ambit of the invention as herein set forth and defined by the following claims.

The invention claimed is:

1. A fire prevention shield for an internal combustion engine including:

a shield baffle plate having a leading portion and an intermediate portion, an exposed leading edge of said leading portion being sized and configured to be located adjacent to the engine; and a mounting means sized and configured to mount the shield baffle plate at a predetermined position with respect to an upper surface of a muffler of the engine, such that:

an air passage is located between the upper surface of the muffler and the shield baffle plate, wherein both of said leading portion and intermediate portion provide the air passage with a contracting cross-sectional area to accelerate airflow across said upper surface of the muffler, the air passage having an air inlet opening between said exposed leading edge of said shield baffle plate and the upper surface of the muffler, wherein a cross-sectional area of the air passage is greatest at the air inlet opening;

a longitudinal axis of the shield baffle plate extends generally parallel to the muffler, such that the exposed leading edge extends from a front end of the muffler toward a back end of the muffler;

the longitudinal axis of the shield baffle plate extends generally perpendicular to a longitudinal axis of the internal combustion engine, such that the air inlet opening is oriented to receive airflow generated by a cooling fan of the internal combustion engine; and an exhaust extension of the muffler extends from the upper surface of said muffler and through an aperture provided in the shield baffle plate.

2. The fire prevention shield of claim 1, wherein the shield baffle plate includes at least one mounting bracket, the at least one mounting bracket having:

a body portion secured to the shield baffle plate, a generally arcuate cutout being defined in the body portion; and an arcuate plate secured to the arcuate cutout to define an arcuate step;

wherein the mounting means includes a generally circular clamp sized and configured to circumferentially surround the muffler, and the arcuate step is sized and configured to be secured between the circular clamp and the muffler.

3. The fire prevention shield of claim 2, wherein the circular clamp is a worm drive clamp.

4. The fire prevention shield of claim 1, wherein the exposed leading edge projects forwardly and upwardly from the leading portion of the shield baffle plate, the intermediate portion extends rearwardly from the leading portion, and a deflection portion of the shield baffle extends rearwardly and downwardly from the intermediate portion, the deflection portion being in spaced disposition with respect to the muffler and shaped to extend at a generally constant distance from an external face of the muffler; and a trailing portion extending downwardly from the deflection portion and terminating at a trailing edge, wherein the leading portion, the intermediate portion, the deflection portion, and the trailing portion are planar surfaces integrally formed from a single sheet and defined by folds formed in the sheet.

5. The fire prevention shield of claim 4, wherein the deflection portion is sized and configured to define between about 45 and 90 degrees of arc.

6. The fire prevention shield of claim 1, wherein the shield baffle plate is fabricated from aluminum.

7. The fire prevention shield of claim 6, wherein the shield baffle plate is coated with a high temperature ceramic.

8. The fire prevention shield of claim 1, wherein the mounting means permits the shield baffle plate to be angularly adjusted relative to the muffler to alter a cross-sectional size of the air inlet opening.

9. A fire prevention shield for an internal combustion engine including:

a shield baffle plate having a leading portion and an intermediate portion, an exposed leading edge of said leading portion being sized and configured to be located adjacent to the engine, the shield baffle plate being formed from a folded metal sheet; and a mounting means sized and configured to mount the shield baffle plate at a predetermined position with respect to a muffler of the engine, such that:

an air passage is located between an upper surface of the muffler and the exposed leading edge of the shield baffle plate, the air passage having an air inlet opening located adjacent to the engine, wherein a cross-sectional area of the air passage is greatest at the air inlet opening and both the leading portion and intermediate portion provide the air passage with a contracting cross-sectional area to accelerate air flow across said muffler; and the exposed leading edge extends from a front end of the muffler toward a back end of the muffler, such that; the exposed leading edge projects forwardly and upwardly from the leading portion of the shield baffle plate, the intermediate portion extends rearwardly from the leading portion, and a deflection portion of the shield baffle plate extends rearwardly and downwardly from the intermediate portion, the deflection portion being in spaced disposition with respect to the muffler and shaped to extend at a generally constant distance from an external face of the muffler; and a trailing portion extending downwardly from the deflection portion and terminating at a trailing edge, wherein the leading portion, the intermediate portion, the deflection portion, and the trailing portion are planar surfaces integrally formed and defined by the folded metal sheet;

the shield baffle plate includes at least one mounting bracket, the mounting bracket having:

a body portion secured to the shield baffle plate, a generally arcuate cutout being defined in the body portion; and an arcuate plate secured to the arcuate cutout to define an arcuate step;

wherein the mounting means includes a generally circular clamp sized and configured to circumferentially surround the muffler, and the arcuate step is sized and configured to be secured between the circular clamp and the muffler;

wherein the mounting means permits the shield baffle plate to be angularly adjusted relative to the muffler to alter a cross-sectional size of the air inlet opening.

* * * * *